US009889906B2

(12) United States Patent
Rodenburg

(10) Patent No.: US 9,889,906 B2
(45) Date of Patent: Feb. 13, 2018

(54) TOWING SYSTEM FOR A TUGBOAT

(71) Applicant: NOVA PATENT B.V., Alphen aan den Rijn (NL)

(72) Inventor: Robert Rodenburg, Alphen a.d. Rijin (NL)

(73) Assignee: NOVA PATENT B.V., Alphen aan den Rijn (NL)

( * ) Notice: Subject to any disclaimer, the term of this patent is extended or adjusted under 35 U.S.C. 154(b) by 0 days.

(21) Appl. No.: 14/764,275

(22) PCT Filed: Jan. 30, 2014

(86) PCT No.: PCT/NL2014/050047

§ 371 (c)(1),
(2) Date: Jul. 29, 2015

(87) PCT Pub. No.: WO2014/120003

PCT Pub. Date: Aug. 7, 2014

(65) Prior Publication Data

US 2015/0360753 A1 Dec. 17, 2015

(30) Foreign Application Priority Data

Jan. 30, 2013 (EP) ..... 13153264

(51) Int. Cl.
*B63B 21/56* (2006.01)
*B63B 21/58* (2006.01)
*B63B 35/68* (2006.01)

(52) U.S. Cl.
CPC ..... *B63B 21/56* (2013.01); *B63B 21/58* (2013.01); *B63B 35/68* (2013.01)

(58) Field of Classification Search
CPC ..... B63B 21/00; B63B 21/56; B63B 21/58; B63B 21/60; B63B 2021/00;
(Continued)

(56) References Cited

U.S. PATENT DOCUMENTS 1,016,619 A * 2/1912 Froger ..... B63B 35/816 114/253
3,147,732 A * 9/1964 Nishioka ..... B63B 21/56 114/254
(Continued)

FOREIGN PATENT DOCUMENTS

DE 1 481 729 A1 3/1969
EP 0 104 714 A1 4/1984
(Continued)

OTHER PUBLICATIONS

International Search Report, dated Apr. 4, 2014, from corresponding PCT application.

*Primary Examiner* — Daniel V Venne
(74) *Attorney, Agent, or Firm* — Young & Thompson

(57) ABSTRACT

The towing system for a tugboat consists of a ring arranged on the deck of the tugboat along which a cart moves on which a winch is arranged. At a larger diameter of the ring manufacturing inaccuracies of the cart respectively the ring respectively deformations can be absorbed in a particularly efficient way by arranging springs between the wheels that engage the ring-shaped base and the cart on which the wheels are arranged. In particular, such springs are rubber springs such as neoprene springs. These can be arranged as blocks, bushes or the like. Preferably, the cart includes a relatively stiff box on which a winch and, more in particular, an electrical winch is arranged. In particular, the cart is a ring, extending around circumferentially.

12 Claims, 5 Drawing Sheets

(58) Field of Classification Search
CPC ..... B63B 2021/001; B63B 2021/003; B63B 2021/004; B63B 35/66; B63B 35/68
USPC ..... 114/242, 249, 253
See application file for complete search history.

(56) References Cited

U.S. PATENT DOCUMENTS 3,892,386 A * 7/1975 Hogan ..... B66D 1/36 114/254
5,408,947 A * 4/1995 Curto ..... B63B 21/66 114/253
5,967,076 A * 10/1999 Tinnen ..... B63B 21/56 114/254
6,662,741 B1 * 12/2003 Van Der Laan ..... B63B 21/56 114/249

FOREIGN PATENT DOCUMENTS

EP 1 208 035 B1 5/2002
WO 2006/049496 A1 5/2006

* cited by examiner

TOWING SYSTEM FOR A TUGBOAT

BACKGROUND OF THE INVENTION

The present invention relates to a towing system for a tugboat comprising a ring-shaped base for attachment to a ship's deck, and a circular turning ring that is displaceable along that base, which circular turning ring is provided with a winch, as well as a number of wheels for engagement with that base.

DESCRIPTION OF THE RELATED ART

Such a towing system is known from EP-1.208.035 B1 which describes in paragraphs [0003]-[0005] that: "During towing, there is a cable connection between the tugboat and the ship. On board the tugboat, this cable usually runs through a towing eyelet and is attached to a towing winch or towing hook. The towing eyelet is arranged as low as possible in the vertical direction on the tugboat, in order to minimize the tilting of the tugboat and to prevent the tugboat from capsizing. With respect to this towing eyelet, the towing cable can turn sideways through 90° or more in the horizontal plane, towards both boards. In the case of a towing winch, the cable length can be adapted to the desired towing length and maneuvering distance. In the case of a towing hook or attachment point, the towing cable length is fixed".

This prior art European patent further describes that a discontinuous ring is attached to the deck of a vessel such as by welding and a further ring, displaceable on the base, is arranged around this ring, which is provided with a cable guide. Because of this, it is possible to expand the applications of the tugboat, especially by improving the maneuverability and stability. With this construction, the towing cable can be brought into any desired position with respect to the tugboat and can be fully loaded therein.

Such a construction is particularly successful. However, the costs for producing the towing system are relatively high. After all, both the ring arranged on the deck and the ring, displaceable along there, that do not necessarily have to be circularly shaped, must be accurately produced to enable proper adjoinment of the wheels lying there in between. Especially with large forces it is of importance to distribute these forces evenly over the wheels in such a way that these can be transmitted via the wheels into the stationary ring arranged on the ship's deck.

Moreover, it has appeared that during use small deformations can occur, as a result of which the true circularity of the two rings can no longer be guaranteed.

SUMMARY OF THE INVENTION

It is the aim of the present invention to avoid this disadvantage and to provide a towing system that can be produced cheaper and is less sensitive to the accuracy of two rings rotating with respect to each other.

This aim is achieved with a towing system as described above, in that those wheels are connected to the circular turning ring.

According to the present invention the wheels are no longer rigidly connected to the circular turning ring that is displaceable along the base. The wheels thereof can perform mutual displacements to absorb inaccuracies of the circular turning ring as well as the base. Because of this a more optimal force distribution over the wheels can take place and it is possible to suffice with a cheaper construction for the wheels.

The rings can be fully closed but can also just comprise a ring part. Moreover, the rings can be constructed circularly as well as elliptically.

The wheels may be arranged on auxiliary arms. Therein, a number of wheels can be arranged on an auxiliary arm and it is also possible to arrange a wheel/a set of wheels each time on an auxiliary arm. The different auxiliary arms can be hingeably arranged with respect to each other and can be connected to the circular turning ring via a further hinge construction and a main arm.

It shall be understood that the wheels are arranged especially at those places where the largest force is to be expected. The wheels shall be arranged depending on the construction of the base. The forces described above concern forces in diametrical direction of the base (ship's deck) as well as forces acting perpendicularly thereto, that occur when towing a vessel, wherein the point of engagement on the vessel lies much higher than the ship's deck.

The circular turning ring may preferably be constructed from a relatively stiff box part on which, for example, a winch is arranged. Connecting thereto a belt-like construction may be present that engages around the base for absorbing the diametrically acting forces. However, it is also possible to construct the circular turning ring as a box part that extends, just like the abovementioned box part, over a very limited part of the circumference of the base. However, with this embodiment the box part is not extended with a belt part or the like but provided with wheels that absorb the diametrically acting forces. These wheels then obviously engage the inner circumference of the base and not the outer circumference as in the abovementioned example.

According to an advantageous embodiment of the invention, springs are preferably arranged between the wheel connection and the circular turning ring. According to an advantageous embodiment such springs can comprise rubber springs. By means of example the use of cylindrical bushes is mentioned. Another possibility is to embody the springs as a rubber block. Depending on the application the actual rubber material will be selected. It is observed that neoprene rubber is a material that is especially suitable for most applications.

BRIEF DESCRIPTION OF THE DRAWING FIGURES

As described above, preferably a winch is arranged on the box part of the circular turning ring.

The invention will be elucidated by way of exemplary embodiments shown in the accompanying drawings, in which:

FIG. 1 schematically shows a vessel provided with a towing system according to the invention;

Figure 5:
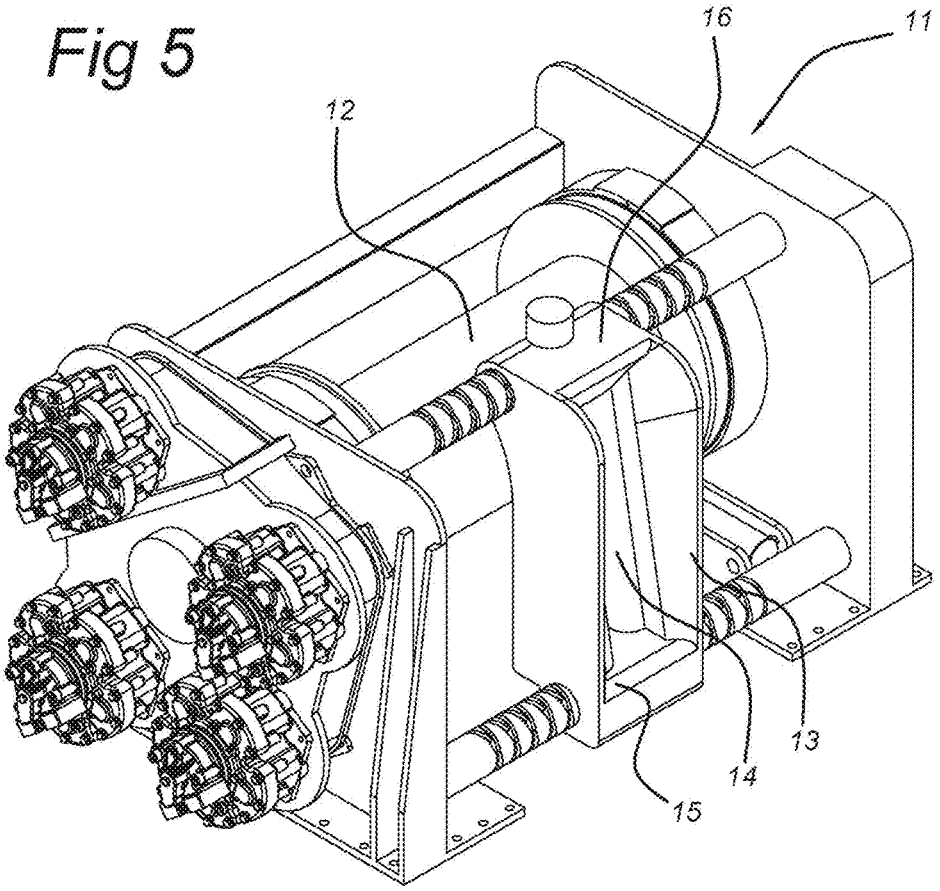

FIG. 5 perspectively shows a winch arranged on the towing system, and

Figure 6:
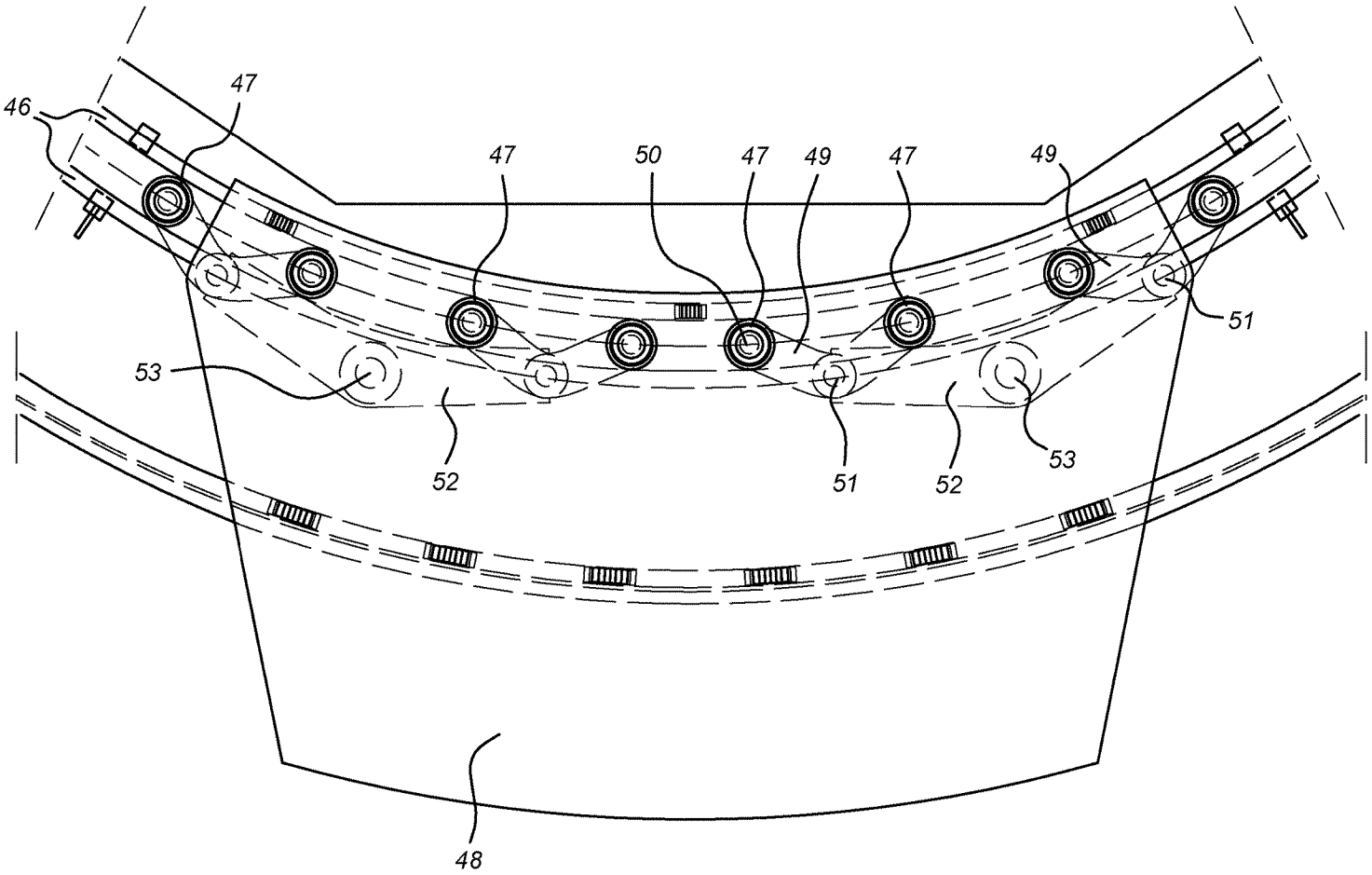

FIG. 6 shows a variant of the embodiment as described above.

DETAILED DESCRIPTION OF THE INVENTION

Figure 1:
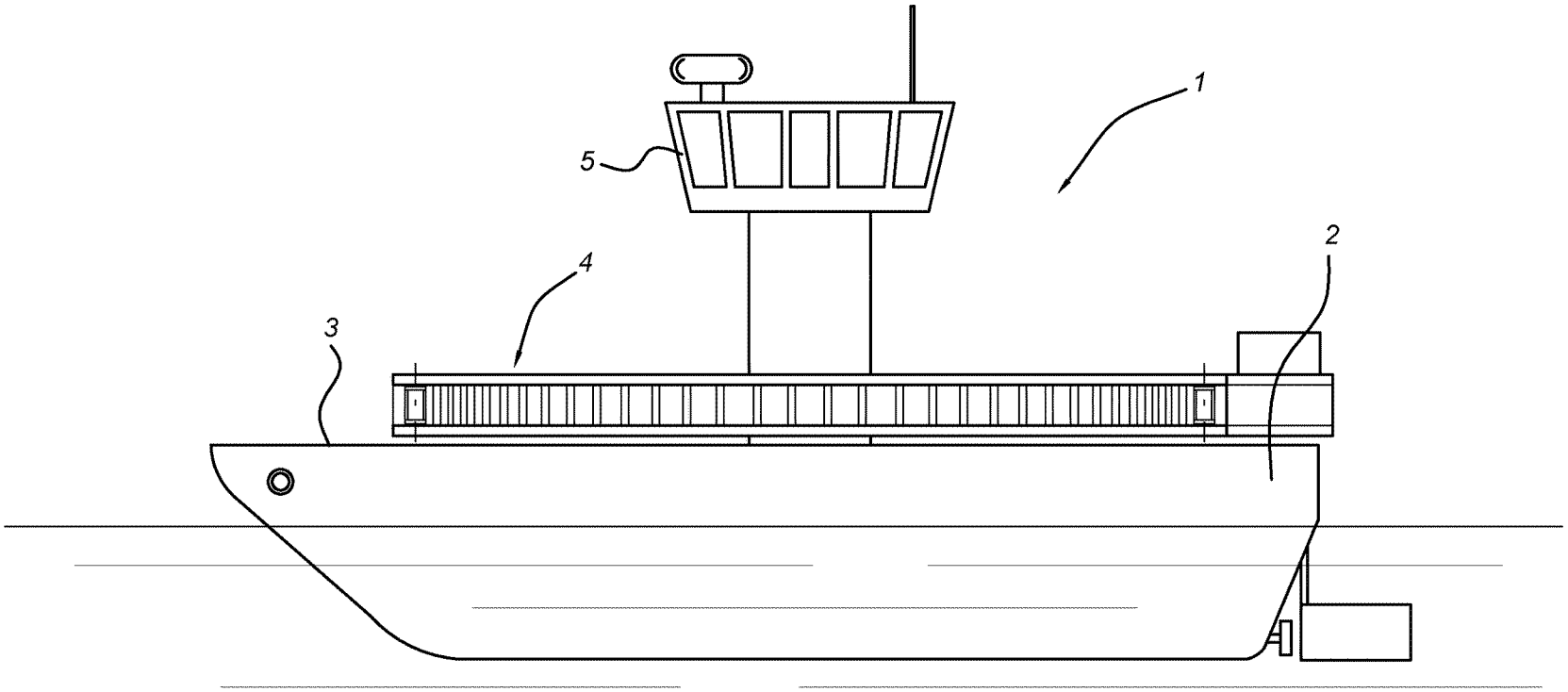

In FIG. 1 a vessel is indicated by 1. This comprises a tugboat provided with a hull 2, deck 3 and a towing system 4 arranged on the deck. This towing system 4 is rotatable around a pilot house 5 that is fixedly connected to the vessel.

Figure 2:
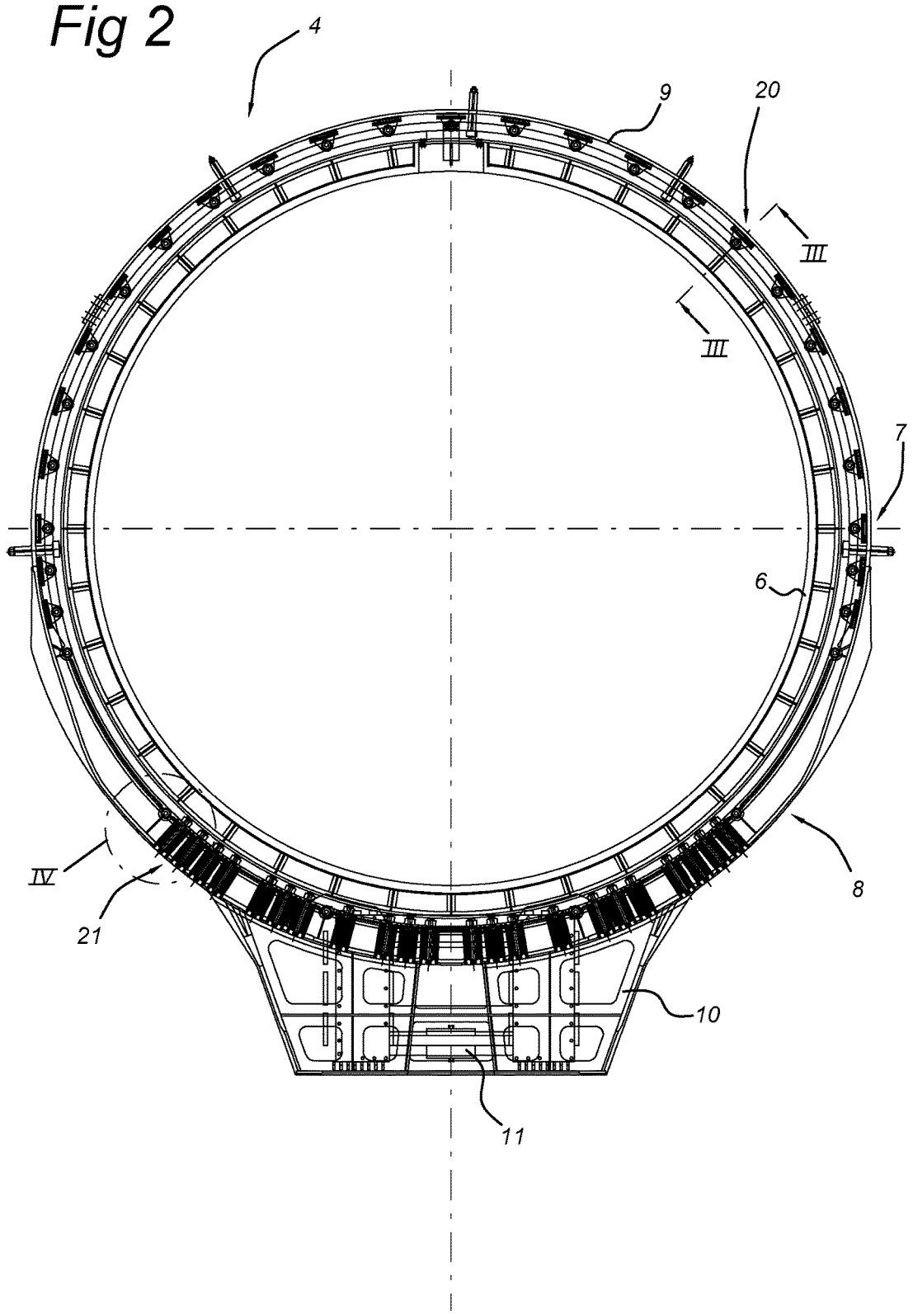
FIG. 2 shows a top view of the towing system according to the invention.

As is apparent from FIG. 2, the towing system 4 consists of a stationary ring or ring-shaped base 6 that is fixedly attached to the deck of the vessel and a circular turning ring 7 rotatably arranged thereon. The circular turning ring 7 consists of a relatively stiff box part 8 and a belt part 9 connecting thereto. This belt can be embodied as a simple steel belt. However, it is also possible to provide it with reinforcements or to construct it, for example, as a chain. It is especially of importance that it is capable of absorbing the diametrically acting forces. Box part 8 and belt part 9 are externally arranged around the circular turning ring 7. The box part 8 is provided with a platform 10 on which a winch 11 is arranged. Because of such a box a particularly high torsional stiffness is achieved, as a result of which the forces acting on the winch can be absorbed.

As is apparent from FIG. 5 the winch 11 consists of a winch drum 12, cable guides 13, roll 14 and feed 15. Feed 15 consists of a suitably rounded part for guiding the towing cable (not shown) along there. The winch according to the present invention is fixedly arranged on the platform and it has appeared that by proper dimensioning it is no longer necessary to arrange such a winch hingeably, with all associated disadvantages thereof.

The vertical forces will not reach the spool-up mechanism because the thread can move up and down freely in the spool-up mechanism between the upper and lower limit.

Transversal forces possibly acting on such a spool-up mechanism can be large and the forces can be absorbed by providing either two spool shafts, whether or not provided with cross thread, or spool shafts with normal screw thread and operation by a separate motor.

The forces acting on such a winch 11 respectively platform 10 can be large. One thing and another depend on the capacity of the tugboat 1. These forces may vary from tens to hundreds of tons. This means that upon exerting such a tensional force on the circular turning ring 7 large forces have to be transmitted to the stationary ring 6. For that purpose, according to the invention, wheels are present that are connected to the circular turning ring 7.

In contrast with the prior art, such a connection is not a stiff connection but a resilient connection. According to the present invention, a spring is arranged between the wheel attachment and the circular turning ring 7 and more in particular a rubber spring.

The embodiment of this rubber spring depends on the position of the wheels.

Figure 3:
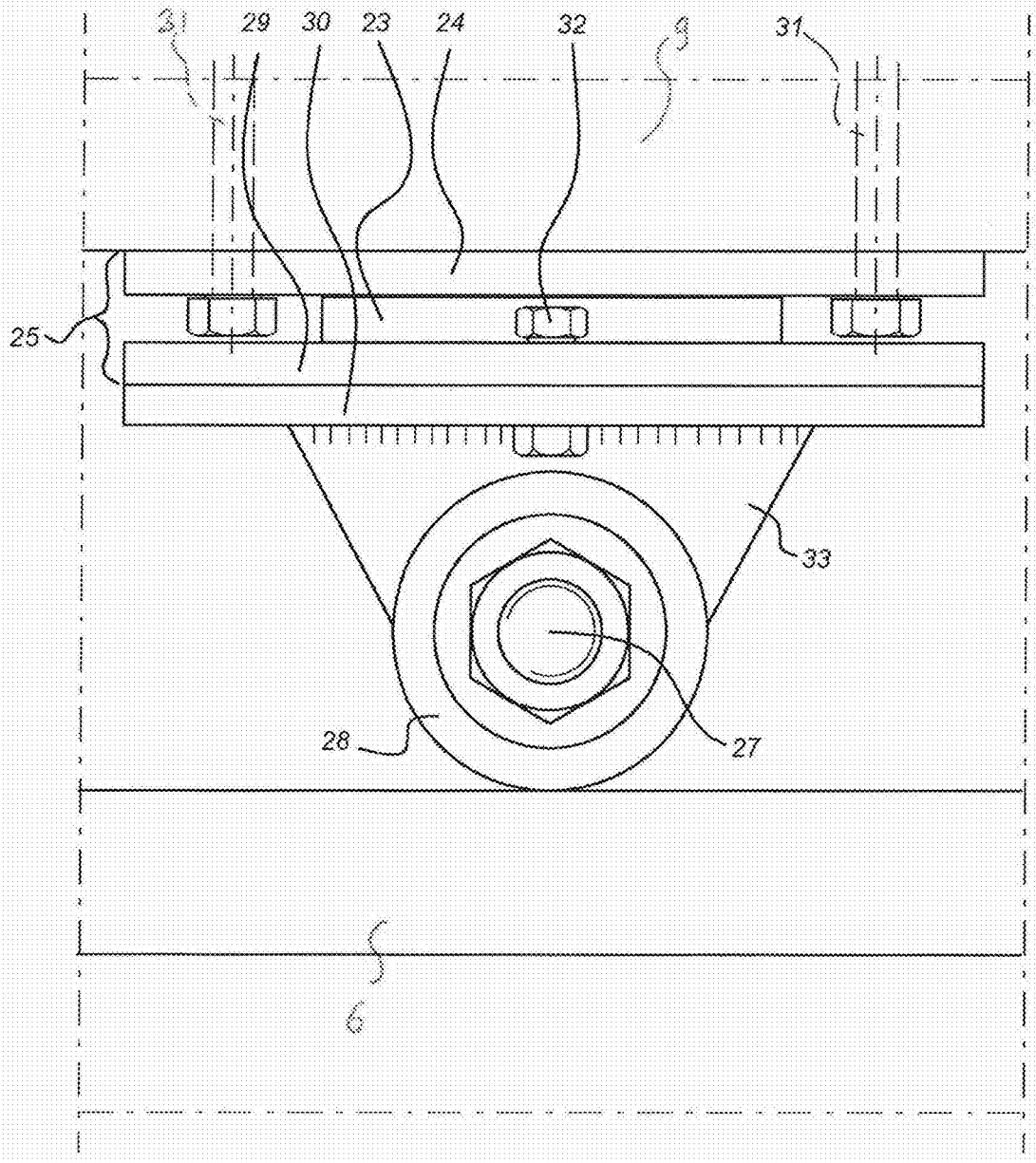
FIG. 3 shows the close-up view III of FIG. 2.

In FIG. 3 a set of wheels 28 is shown that is arranged on the belt part 9 of the circular turning ring 7. An assembly is attached to the belt part 9, indicated by 25, comprising two spaced-apart plates 24 and 29. Rubber spring 23, embodied as a block, is vulcanized to these plates 24 and 29. Plate 24 is attached with bolts 31 while plate 29 is attached to plate 30 with bolt 32. On plate 30 attachment eyelets 33 are arranged in which a shaft 27 is inserted that is provided with wheels 28 on both sides. Possibly, the plates 24 and 29 can be provided with a cooperating guide for absorbing longitudinal forces. By constructing one or more of the wheels shown in FIG. 2 in this manner the force distribution for transmitting forces from the circular turning ring 7 to the base part or stationary ring 6 can be effected in a relatively uniform manner.

The forces acting on the wheels 28 are diametrically directed.

Figure 4:
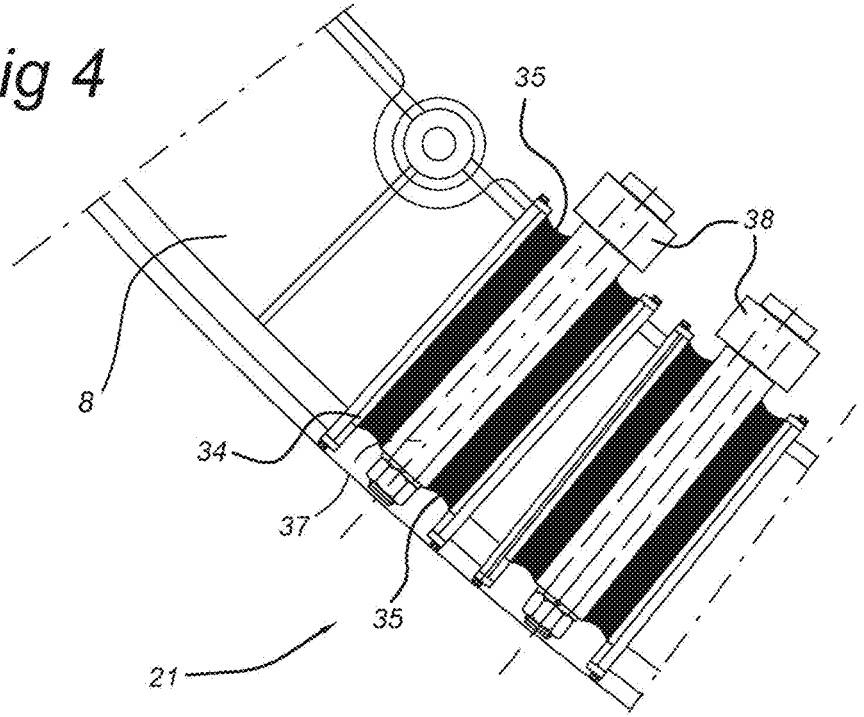
FIG. 4 shows the close-up view IV of FIG. 2.

Near the "front side", i.e. the winch side of the circular turning ring 7, different forces act for generating forces. These will particularly be directed upwards or downwards. For that purpose, the wheel attachment is constructed differently. This is apparent from FIG. 4 that shows wheel assembly 21. It is apparent that two spaced-apart wheels 38 are present that each rotate around a substantially horizontal shaft 37. This shaft 37 is separated from outer bush 34 via a bush-shaped rubber spring 35 that is connected to the box part 8 in any way known from the prior art. By using two opposing wheels between which the rail is received upward respectively downward forces can be absorbed. With the present invention it is possible to reduce the peak load on each wheel.

Because of this, the wheels are loaded to a lesser extent, as well as the associated bearings. Peak loads of 40-50 tons/wheel are not unusual in the prior art. The present invention makes it possible to limit such forces considerably.

As a matter of course, the spring characteristic of the rubber spring will have to be adapted to the expected load. By means of example, a spring characteristic of 1-6 tons/mm is mentioned. It shall be understood that other loads are also conceivable and these will lead to a different construction of the spring.

In FIG. 6 a variant of the construction as described above is shown, wherein a method different from a springy method is used that also acts in a force distributing manner. In this embodiment the box part and the platform are integrated into one part. Such a construction can also be used with the embodiment as described above. Fixed rails are indicated by 46 and wheels 47 are locked up between these rails. Pairs of wheels are each time connected to auxiliary arms 49 via rotational shafts 50. Each auxiliary arm, near the middle thereof, is connected to a hinge 51 with a main arm 52. In the example as shown, near each of the ends of main arm 52, each time, such an auxiliary arm 49 is hingeably attached. In the middle the main arm 52 is connected to the box part 48 via a hinge 53, on which a winch and the like can be arranged in the manner described above. In principle, one or more main arms can be used.

With the present invention, it is possible to realize a carrousel construction without particularly accurate working of the different parts and with parts that can be obtained relatively cheaply, which will promote the introduction thereof on different ships even more.

After reading the above, those skilled in the art will immediately be able to think of variants which are obvious and fall within the scope of the attached claims. Therein, rights are explicitly requested for the variants that are described in the dependent claims without combination with the main claim.

The invention claimed is:

1. A towing system (4) for a tugboat (1) comprising:

a ring-shaped base (6) for attachment to a ship's deck (3);

a circular turning ring (7) displaceable along said ring-shaped base, the circular turning ring being comprised of i) a box part (8), ii) a belt part (9) connected to the box part, iii) a winch (11) arranged on the box part (8), and iv) plural wheels (28, 38) that engage with said ring-shaped base (6), each of said plural wheels supported on a respective one of plural shafts (27, 37); and springs (23, 35) that moveably connect each of said plural shafts to said circular turning ring, wherein said springs are configured for distributing a force over said plural wheels by allowing mutual displacement of said plural wheels, wherein said belt part (9) engages around the ring-shaped base (6) for absorbing diametrically acting forces.

2. The towing system according to claim 1, wherein said box part (8) comprising a platform (10) on which said winch (11) is arranged.

3. The towing system according to claim 1, wherein the ring-shaped base has an outer circumference, and a set of the plural wheels (28) engage said outer circumference of the ring-shaped base (6).

4. The towing system according to claim 3, wherein said springs are rubber springs.

5. The towing system according to claim 4, wherein said rubber springs comprise rubber blocks (23) arranged between a set of the plural shafts (27) supporting the set of the plural wheels (28) and the belt part (9).

6. The towing system according to claim 1, wherein the belt part comprises a steel belt.

7. The towing system according to claim 1, wherein, said plural wheels (28, 38) comprising a first set of wheels (28) and a second set of wheels (38), wherein the plural shafts (27, 37) include a first set of shafts (27) and a second set of shafts (37), the second set of shafts (37) being horizontal shafts (37), the ring-shaped base has an outer circumference, and the first set of wheels (28) engage said outer circumference of the ring-shaped base (6), said springs comprise rubber blocks (23) arranged between respective ones of the first set of shafts (27) supporting the first set of the wheels (28) and the belt part (9), wherein the circular turning ring (7) comprises a wheel assembly (21) on a side of the circular turning ring where the winch is arranged, said wheel assembly comprising two spaced-apart and opposing wheels (38) of said second set of wheels (38) that each rotate around a respective one of the second set of shafts (37), and wherein a rail of the ring-shaped base (6) is received between the two spaced-apart and opposing wheels (38) such that upward and downward directed forces acting on said two spaced-apart and opposing wheels can be absorbed.

8. The towing system according to claim 7, wherein, said springs include bush-shaped rubber springs (35) that are connected to the box part (8) and extend along a longitudinal axis of each said horizontal shaft (37), each said horizontal shaft (37) is held within a corresponding on of the bush-shaped rubber springs (35); and wherein the box part further comprises an outer bush (34), the horizontal shaft (37) being separated from the outer bush (34) by one of the bush-shaped rubber springs (35).

9. The towing system according to claim 1, wherein a set of said plural shafts (37) comprise horizontal shafts (37);

wherein the winch is an electrical winch (11), wherein the circular turning ring (7) comprises a wheel assembly (21) on a side of the circular turning ring where the winch is arranged, said wheel assembly comprising two spaced-apart and opposing wheels (38), of said plural wheels, that each rotate around one of said horizontal shafts (37), and wherein a rail of the ring-shaped base (6) is received between the two spaced-apart and opposing wheels (38) such that upward and downward directed forces acting on said two spaced-apart and opposing wheels can be absorbed.

10. The towing system according to claim 9, wherein said springs include a bush-shaped rubber spring (35) that is connected to the box part (8) and extends along a longitudinal axis of each said horizontal shaft (37), and within which bush-shaped rubber spring (35) the horizontal shaft (37) is held; and wherein the box part further comprises an outer bush (34), wherein the horizontal shaft (37) is separated from the outer bush (34) by the bush-shaped rubber spring (35).

11. A towing system (4) for a tugboat (1) comprising:

a ring-shaped base (6) that attaches to a ship's deck (3), the ring-shaped base (6) comprising a pair of fixed rails (46) comprising a first rail facing a second rail; and a box part (48) displaceable along said ring-shaped base;

a winch (11) supported on the box part (48);

two auxiliary arms (49) hingeably attached to each end of said main arm (52);

plural wheels (47) comprising i) at least two spaced-apart wheels (47) that are attached to a first of said auxiliary arms (49), and ii) at least two further spaced-apart wheels (47) that are attached to a second said auxiliary arms (49), wherein said at least two spaced-apart wheels (47) and said at least two further spaced-apart wheels (47) are locked up between the first and second rails, wherein said two auxiliary arms (49) connect said at least two spaced-apart wheels (47) and said at least two further spaced-apart wheels (47) to said box part (48) via each said main arm (52), wherein said auxiliary arms (49) and said main arm (52) together are configured for distributing a force over said plural wheels by allowing displacement of the plural wheels, the plural wheels thereby absorbing diametrically acting forces.

12. The towing system (4) for a tugboat (1) according to claim 11, wherein said first rail has an outer circumference and said second rail an inner circumference, and said at least two spaced-apart wheels (47) and said at least two further spaced-apart wheels (47) engage said outer circumference of said first rail and said inner circumference of said second rail.

* * * * *